US005534880A

United States Patent [19]

Button et al.

[11] Patent Number: 5,534,880

[45] Date of Patent: Jul. 9, 1996

[54] STACKED BICONICAL OMNIDIRECTIONAL ANTENNA

[75] Inventors: Donald D. Button, Standish; William D. Wyatt, Westbrook; James F. McGrath, Cape Elizabeth, all of Me.

[73] Assignee: Gabriel Electronics Incorporated, Scarborough, Me.

[21] Appl. No.: 411,870

[22] Filed: Mar. 28, 1995

Related U.S. Application Data

[63] Continuation of Ser. No. 33,044, Mar. 18, 1993, abandoned.

[51] Int. Cl.[6] ..... H01Q 13/04

[52] U.S. Cl. ..... 343/774; 343/878; 343/905

[58] Field of Search ..... 343/773–775, 343/853, 890, 891, 878, 905; H01Q 13/04

[56] References Cited

U.S. PATENT DOCUMENTS

| | | | |
|---|---|---|---|
| 2,532,551 | 12/1950 | Jarvis | 250/33.63 |
| 2,533,236 | 12/1950 | Felsenheld | 343/905 |
| 2,711,533 | 6/1955 | Litchford | 343/106 |
| 2,726,388 | 12/1955 | Kandoian et al. | 343/774 |
| 2,866,194 | 12/1958 | Stavis et al. | 343/725 |
| 2,907,032 | 9/1959 | Wheeler | 343/758 |
| 3,124,802 | 3/1964 | von Dall'Armi | 343/891 |
| 3,605,099 | 9/1971 | Griffith | 343/771 |
| 3,795,914 | 3/1974 | Pickles | 343/756 |
| 3,942,180 | 3/1976 | Rannou et al. | 343/725 |
| 3,943,522 | 3/1976 | Ben-Dov | 343/890 |
| 5,019,832 | 5/1991 | Ekdahl | 343/774 |
| 5,204,688 | 4/1993 | Loiseau et al. | 343/891 |

FOREIGN PATENT DOCUMENTS

| | | | |
|---|---|---|---|
| 0411363 | 2/1991 | European Pat. Off. . | |
| 3122016 | 12/1982 | Germany | 343/773 |

OTHER PUBLICATIONS

1984 International Symposium Digest Antennas and Propagation, vol. I, 1984, Boston, MA, pp. 173–176, McNamara et al. "Some Design Considerations for Biconical Antennas".

*Primary Examiner*—Michael C. Wimer
*Attorney, Agent, or Firm*—Robert M. Asher

[57] ABSTRACT

An omnidirectional antenna with minimal gain variation over the 360° azimuth. A plurality of biconical antennas are stacked vertically. A radome covering the antenna and cylindrically encasing the antenna supports the stack of biconical antennas. A bundle of transmission lines is helically wound about the cylindrical periphery of the biconical antennas, preferably at an angle between 37° and 41°. Each biconical antenna is formed by two truncated flared apart reflecting surfaces that are connected by a nonconductive spacing collar between their truncated portions.

16 Claims, 2 Drawing Sheets

STACKED BICONICAL OMNIDIRECTIONAL ANTENNA

This is a continuation of application Ser. No. 08/033,044 filed on Mar. 18, 1993, now abandoned.

BACKGROUND OF THE INVENTION

The present invention relates to omnidirectional antennas, particularly a stacked biconical antenna.

Biconical antennas have commonly been used for their omnidirectional characteristics in azimuth. It has been found that given a desired gain, the volume for a biconical antenna can be reduced by replacing a single biconical with a stacked array of a plurality of biconical antennas. Several examples of stacked biconical antennas are discussed below.

U.S. Pat. No. 2,532,551 (Jarvis) discloses two stacked biconical antennas, one for transmitting and the other for receiving. The two biconical antennas are separated from one another by a separation pipe. Each antenna has its own cable separately fed to it through the axis of the antenna.

U.S. Pat. No. 2,726,388 (Kandoian) discusses the existence of stacked biconical radiators and the arrangement of transmission leads and wave guides by spiralling them around the stacked array. Kandoian et al. expressed their reservations regarding the shortcomings of such a system. Kandoian et al. discloses instead the arrangement of transmission lines through the axis of the stacked antennas.

U.S. Pat. No. 2,711,533 (Litchford) discloses a stack of three biconical antennas in which the biconical sections are supported by metallic members. Litchford recommends that the radiating elements in each of the biconical sections be excited in phase to ensure that their horizontal radiations from each section are additive.

U.S. Pat. No. 3,795,914 (Pickles) discloses a stack of biconical antennas in which a styrofoam support encircles the periphery of the stacked antennas. Absorbing wires are arranged about the antennas and the styrofoam supports to improve absorption of reflected energy. An outer radome encircles the stack of biconical antennas which are rotatable within the radome.

SUMMARY OF THE INVENTION

The present invention is directed to an omnidirectional antenna formed by a stack of biconical antennas. Each biconical antenna has an electromagnetic energy radiating element supported within it. A plurality of transmission cables, one for each radiating element, are arranged upon the stack of biconical antennas such that the omnidirectional antenna has a gain which varies over an entire 360° azimuthal range by less than one dB from a mean gain over said entire 360° azimuthal range for at least all frequencies within a four percent frequency bandwidth. In order to provide a level beam, each of the transmission cables has an equal electrical length. By cutting the cables to varying lengths it is possible to provide the omnidirectional antenna with a tilted beam. The transmission cables are helically wound about the cylindrical periphery of the stacked biconical antennas. The cables are bundled into a single bundle which is progressively smaller as each cable is connected to its corresponding radiating element. The transmission cables are preferably wound in a helix at an angle of about 39°. The omnidirectional antenna of the present invention advantageously provides relatively high gain that is maintained within ±1 dB over the entire 360° azimuthal range.

Other objects and advantages of the present invention will become apparent during the following description of the presently preferred embodiment of the invention taken in conjunction with the drawings.

DETAILED DESCRIPTION OF THE PREFERRED EMBODIMENT

Figure 1:
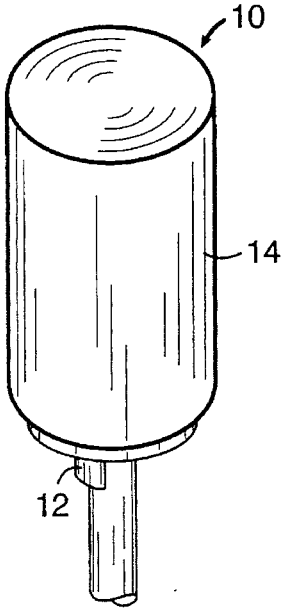
FIG. 1 is an isometric view of the stacked biconical omnidirectional antenna of the present invention.

Referring now to the drawings, the construction of an omnidirectional antenna of the present invention is illustrated. The omnidirectional antenna 10 is typically attached to a pipe by a pipe mount 12. The pipe generally extends from a tower or a building. This allows the antenna to be oriented so that it radiates and receives energy from the horizon. The antenna 10 is encased within a radome 14. The radome 14 is an electromagnetically transparent sheet formed as a cylinder about the outer periphery of the stacked biconical antennas. In addition to providing a weatherproofing function as a typical radome, the radome 14 in the present invention is also used to provide mechanical support for the stack of biconical antennas. The radome 14 extends as a cylinder down around the sides of the biconical antennas. The cylindrical shape of the radome adds to the stiffness of the radome material. The presently preferred radome 14 is an extruded ABS (acrylonitrile-butadiene-styrene) sheet. The radome 14 advantageously provides mechanical support for the stacked antennas without interfering with electrical performance. An antenna housing cap 15 extends over the top of the antenna 10 to protect it from the weather.

Figure 2:
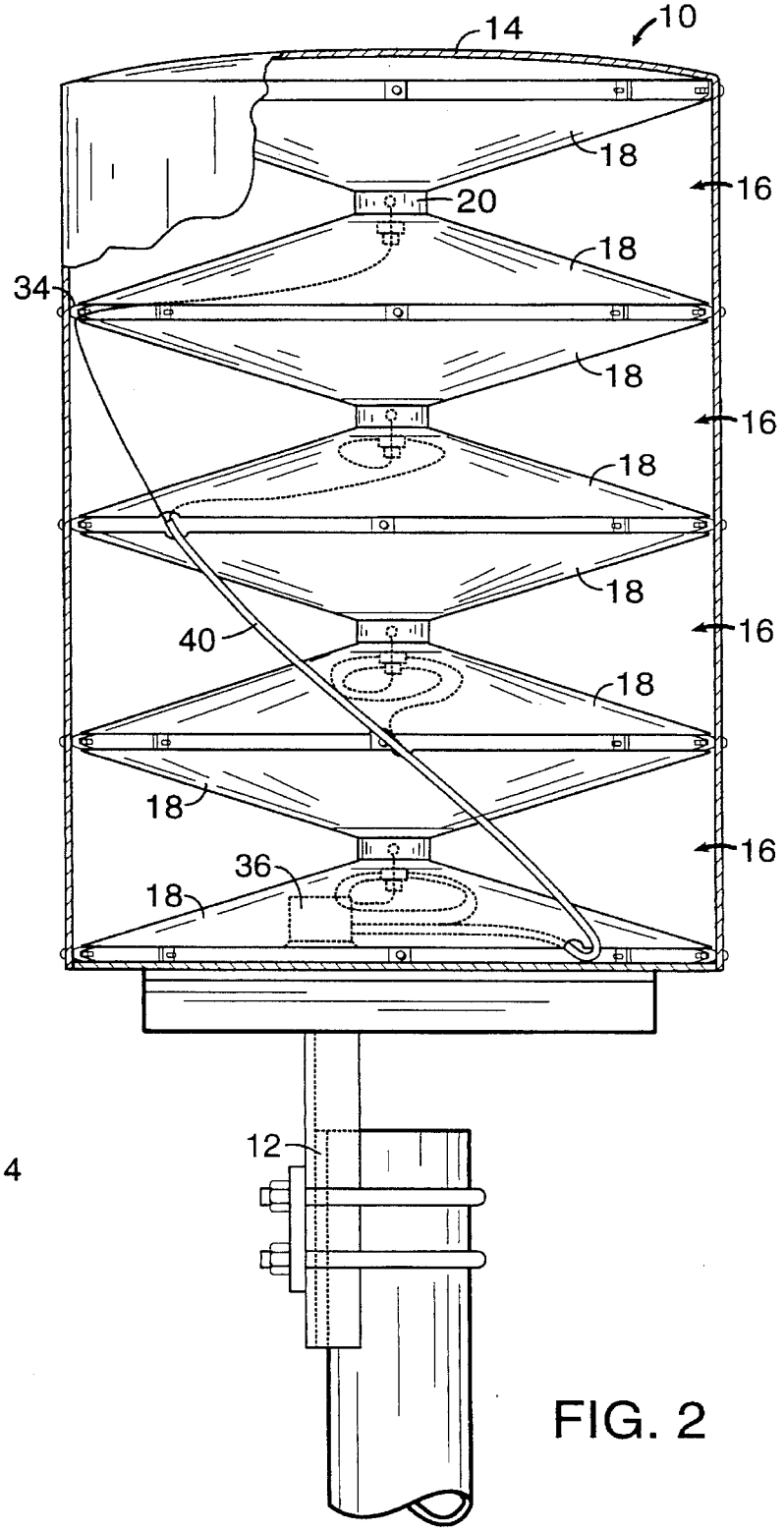
FIG. 2 is a side view of the omnidirectional antenna of FIG. 1 with the radome cut away.

Referring now to FIG. 2, the mechanical configuration of the omnidirectional antenna 10 will continue to be described. The illustrated presently preferred antenna 10 includes a stack of four biconical antennas 16. Each biconical antenna 16 is formed by a pair of truncated flared apart reflecting surfaces 18. The reflecting surfaces are made in the preferred embodiment out of aluminum sheet and are conically shaped with a tilt from the horizon at an angle of 17.85°. In an alternative embodiment, the reflecting surfaces may begin radially from the truncated center portion at a small angle from horizontal, the angle increasing from the center portion to the outer circumference where the angle from horizontal is preferably 17.85°. The flare angle of the reflecting surface may thus increase as the radius along the surface increases. In other words, the alternative reflecting sheets have a curved surface in the radial direction such as a parabolic curve rather than the straight line of a conical surface. In the biconical antenna, the convex sides of the conical sheets in a pair of conical sheets face one another. The truncated portions of the flared apart reflecting sheets are connected to one another by a nonconductive spacing collar 20. The nonconductive spacing collar 20 is a cylindrical pipe cut to a precise length for accurately spacing the two reflecting surfaces from one another. The collar 20 is an electromagnetically transparent structure. The presently preferred material for the collar is polyetherimide resin thermoplastic.

Figure 3A:
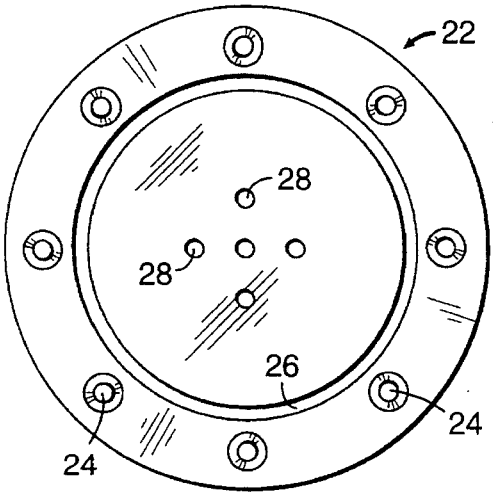
FIG. 3A is a plan view of the hub mounted on the conical surfaces in FIG. 2.
Figure 3B:
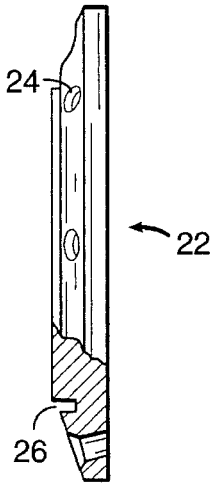
FIG. 3B is a cross-sectional drawing of the hub of FIG. 3A.
Figure 4:
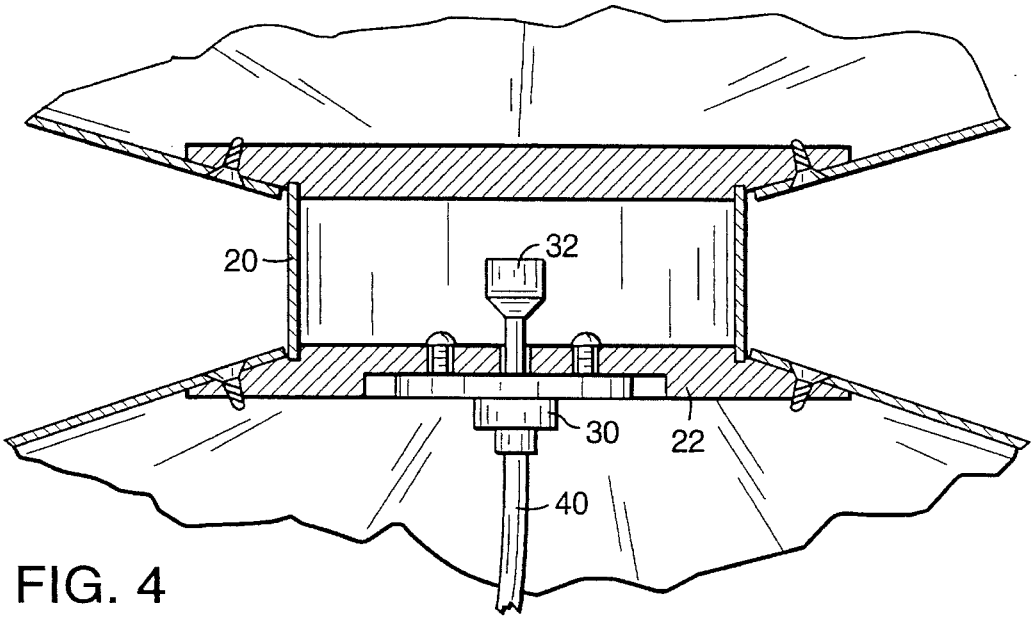
FIG. 4 is a cross-sectional drawing of a portion of the antenna of FIG. 2 where a spacing collar meets a hub.

In order to accurately align the nonconductive collar 20 and the conical reflecting surfaces 18, a hub is attached to the truncated portion of each of the conical surfaces. The hub 22 is shown in greater detail in FIGS. 3A and 3B. The presently preferred material for the hubs is aluminum. The hubs 22 are provided with a plurality of screw holes 24 spaced apart around an outer annulus of the hub. The screw holes 24 are angled so as to be substantially perpendicular to the conical reflecting surface. The screw holes 24 are used for attachment of the hub to the conical reflecting surface by screws. The screw holes are counter sunk so that the screws do not protrude above the hub top surface. A circular groove 26 is provided in the hub 22 so that the nonconductive spacing collar 20 can be easily inserted therein as shown in FIG. 4. Insertion of the collar 20 into the groove 26 axially aligns the collar with respect to the hub and therefore the reflecting surface 18. The nonconductive spacing collar 20 can be secured in the groove in each of the respective hubs 22 by general purpose epoxy. Each of the reflecting surfaces 18 in the pair forming a biconical antenna includes a hub 22 for accurate mounting on the collar 20.

In the center portion of the hub within the bounds of the groove 26, there are a plurality of screw holes for attachment of a cable connector 30. The presently preferred connector 30 is a type "N" connector, more particularly, a female panel receptacle manufactured by Amphenol Corporation of Danbury, Conn. bearing Amphenol part no. 82–97. One end of the connector 30 provides for easy mounting of the electromagnetic coaxial cable. The other end of the connector 30 provides for convenient mounting of an electromagnetic energy radiating probe 32.

The radiating probe 32 functions to convert microwave signals between the TEM mode and radiated energy. The TEM mode microwave signal travels through the transmission cables. The presently preferred radiating probe 32 is made from brass. The radiating probe 32 has a solid base cylindrical portion that expands into a larger and wider solid cylindrical transceiving portion. In the presently preferred embodiment, the output portion of the radiating probe is 0.25 inches in diameter. The base cylindrical portion of the probe 32 has a diameter of 0.095 inches. The base portion is 0.05 inches long. The transceiving portion has a tapered portion at a 45° angle from the narrower base portion to the wider output portion. The length of the transceiving portion from its top end to the base of the tapered portion is 0.183 inches in the presently preferred embodiment.

Figure 5:
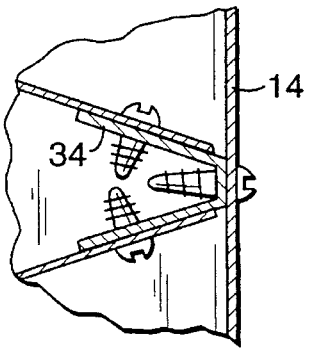
FIG. 5 is a cross-sectional drawing of a portion of the antenna of FIG. 2 where two of the stacked biconical antennas contact one another at the outer periphery.
Figure 2A:
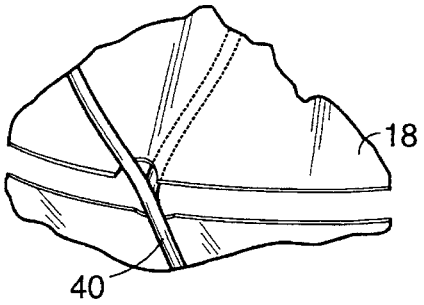
FIG. 2A is an expanded view of a portion of FIG. 2.

The biconical antenna structures 16 are attached to one another at the outer edge of the flared apart reflecting surfaces 18. This is shown in detail in FIG. 5. Attachment clips 34 are spaced in equiangular locations around the circumference of the reflecting sheets. The present embodiment uses eight (8) attachment clips spaced about the circumference at each level. Each clip 34 has a flat base portion and a pair of flared out leg portions. Each leg portion of the attachment clip 34 is screwed with a sheet metal screw to one of the edges of a biconical antenna. The base portion of the clip 34 may be used for a screw attachment of the radome 14 to the biconical antennas. The attachment clips in the presently preferred embodiment are made from aluminum.

The electrical configuration of the antenna shall now be described in greater detail. A power divider 36 is mounted on the pipe mount 12 or the underside of the lowermost biconical antenna. The power divider 36 is connected to a transmission cable which externally attaches for guiding energy to or from the antenna 10. The external cable may be guided out along the pipe mount 12. Rectangular or elliptical waveguide may be substituted in place of the external cable. An adapter would then be required for connection between the waveguide and the power divider. Within the antenna, there is a transmission cable 40 for each biconical antenna 16 that is stacked within the antenna 10. Since the illustrated antenna has four biconical antennas 16 a four-way power divider is needed. The presently preferred four-way power divider is model no. 204347 manufactured by MA/COM Omnispectra, Inc. When the antenna is transmitting, the power divider divides the transmitted signal into four equal amplitude and equal phase components. When the antenna is receiving, the power divider electrically sums the amplitude and phase signals from each of the four radiating elements. The summation signal is provided to the external transmission cable.

There is an internal transmission line 40 for each biconical antenna in the omnidirectional antenna 10. All of the transmission lines 40 are cut and electrically phase matched to identical lengths. This will provide a level elevational beam from the omnidirectional antenna 10. In an alternate embodiment, the lengths of the transmission lines can be successively reduced from one to the next so that the resulting beam from the omnidirectional antenna tilts in elevation. The presently preferred transmission cables are type RG-402/U coaxial cable. They are provided with type "SMA" coaxial connectors for attachment to the power divider 36 and the "N" connectors 30.

In accordance with the present invention, it is desirable to arrange the transmission cables 40 in such a manner on the antenna so as to minimize interference with antenna performance. The transmission cable for the lowermost biconical antenna may be wound in a spiral beneath the lowermost conical section 18 to take up the slack of the extra length. The end is then connected to the "N" connector 30 for the lowermost biconical antenna 16. The remaining transmission cables are directed in a single bundle helically about the cylindrical periphery of the omnidirectional antennas. It has been found that a helical angle of between about 37° and 41° minimizes the interference caused by the transmission cables. The presently preferred angle is about 39°. In the locations where the bundle of transmission lines 40 passes by a conical reflecting sheet 18, the edges of the conical reflecting sheet 18 are notched to accommodate the bundle of transmission lines and to assist in holding the bundle in its desired position. Cable ties are also used to secure the transmission lines to attachment clips 34 where appropriate. In between each pair of conical sections 18 forming a biconical antenna 16, a transmission line from the bundle is redirected between the two antennas towards the "N" connector 30 for ultimately electrical connection to electromagnetic radiating element 32. The transmission line 40 can be wound about in a spiral to take up the slack and then inserted into the connector 30. Thus, the bundle of transmission lines shrinks in diameter as it moves up the omnidirectional antenna 10 until finally the last transmission line is connected to its respective "N" connector 30. The helical angle, preferably 39°, is maintained throughout the cylindrical periphery of the omnidirectional antenna 10 by the notches along the edges of the conical reflecting sheets 18, the cable ties to the attachment clips 34 and the stiffness of the transmission lines themselves.

The operation of the omnidirectional antenna 10 is as follows. In the transmit mode of operation, microwave energy is supplied through a transmission line through the input port of the power divider 36. The signal is divided into four equal amplitude and phase signals. Each of these four signals is delivered to the four radiating probes 32 through the four identical transmission lines 40. Each radiating probe 32 converts this coaxial TEM energy into vertically polarized radiated energy. The conical sections 18 guide this energy in a radial direction from each probe. Since the four probes each radiate equal amplitude and phase signals, the energy from each will collimate together in the far field of the antenna to form a main beam aimed perpendicular to the antenna face or in typical applications, at the horizon. The antenna is reciprocal so that reception operates the same as described above for transmission but in the opposite direction.

The optimal selection of the number of biconical antennas in the omnidirectional antenna 10 can be figured empirically. With a reflector angle of 17.85°, the phase loss is 0.9 dB. Phase loss is dependent upon the angle of biconical reflector, and as the angle becomes steeper, the phase loss rapidly increases. For a stacked biconical antenna with reflector angles of 17.85°, gain (g) can be approximated as follows:

$$g=10 \log (f \cdot n \cdot h/5.9055)-0.9\ db-0.8(n-1) \quad (1)$$

where f=the microwave frequency, h=height of each biconical section and n=the number of biconical sections. The last term is an approximation for the power divider and cable losses for n sections. The gain is then related in terms of volume. When it is desired to minimize the volume of the omnidirectional antenna 10, the following equation may be used to relate volume to gain.

$$v=\pi(5.9055)^3 \cdot 10^{(0.03+0.24n+0.3g)}/f^3 \cdot n^2 \cdot 4(\tan a)^2 \quad (2)$$

where a=the reflector angle of 17.85°. For this angle, the volume is minimized for n=four biconical sections. The change in the reflector angle and the other loss factors will yield different n's. If the losses to the power divider and the cables are actually lower, a larger number of biconical antennas will be possible.

The omnidirectional antenna 10 of the present invention advantageously provides rotational symmetry such that the antenna pattern will be essentially constant in a 360° azimuth circle surrounding the antenna. For any given frequency within a four percent frequency bandwidth, the mean gain may be taken over the entire 360° azimuth range. The performance of the invention is such that at each angle over the 360° azimuth range the gain will vary by less than 1 dB from the mean at that frequency. In fact, the present invention achieves this less than 1 dB variation over the entire azimuth range over at least an entire band, for example, 5.925 $GH_z$ to 6.425 $GH_z$. Thus, the flat gain can be maintained over at least an eight percent frequency bandwidth. Further, with the present invention, it has been found that the required volume for the stacked biconical omnidirectional antenna 10 is less than one-half that of a single element biconical antenna capable of operating at the same gain.

The present invention provides a constant gain antenna over 360° azimuth range with the further advantage of a reduced size antenna. Interference has been reduced with the antenna of the present invention by minimizing the structural supports. The stack of biconical antennas are supported in the vertical direction primarily by the radome 14 and the nonconductive spacing collars 20. The attachment clips 34 mostly serve as an intermediate attachment between the radome and biconical sections.

Of course, if should be understood that various changes and modifications to the preferred embodiment described above will be apparent to those skilled in the art. For example, the reflecting surfaces of the biconical antennas may be curved with increasing flare angles as the radius increases instead of straight as in a conical surface. The external microwave conductor leading to the power divider may be waveguide rather than cable. These and other changes can be made without departing from the spirit and scope of the invention and without diminishing its attendant advantages. It is therefor intended that such changes and modifications be covered by the following claims.

What is claimed is:

1. An omnidirectional antenna comprising:

a plurality of axially aligned electromagnetic energy radiating elements;

a plurality of truncated flared apart reflecting surface pairs connected in an aligned stack, each pair including an upper surface disposed above and a lower surface disposed below one of said radiating elements, adjacent pairs in the stack being attached to one another about their outer circumferences;

the upper and lower surfaces of each of said pairs of reflecting surfaces being separated a fixed distance apart along the axis thereof by only nonconductive means therebetween, said nonconductive means including a plurality of nonconductive spacing collars, each positioned between the upper and lower surfaces of one of said pairs of reflecting surfaces along the axis thereof and around the respective radiating element disposed between said one of said pairs of reflecting surfaces;

a radome forming a cylinder about the outer circumference of the reflecting surfaces of said plurality of truncated flared apart reflecting surface pairs wherein said plurality of truncated flared apart reflecting surface pairs are not surrounded by a polarizing enclosure;

a power divider supported beneath a lowermost reflecting surface of said plurality of truncated flared apart reflecting surface pairs;

a plurality of transmission lines electrically connected to said power divider, a first of said transmission lines extending beneath said lowermost reflecting surface into connection with the radiating element disposed above said lowermost reflecting surface, the remaining transmission lines being helically directed along the cylinder formed by said radome, each of said remaining transmission lines extending from adjacent the cylinder formed by said radome into connection with one of said radiating elements and being fed between an upper surface of one of said reflecting surface pairs and a lower surface of a second one of said reflecting surface pairs, the second one of said reflecting surface pairs being located immediately above said one of said reflecting surface pairs.

2. The omnidirectional antenna of claim 1 wherein said remaining transmission lines are helically directed along the cylinder formed by said radome at an angle between 37° and 41°.

3. The omnidirectional antenna of claim 1 further comprising a plurality of clips connected to adjacent pairs of reflecting surfaces at the outer circumference of one of the reflecting surfaces of one pair and the outer circumference of one of the reflecting surfaces of the adjacent pair, said clips being secured to said radome so that said radome functions to support said plurality of truncated flared apart reflecting surfaces in a vertical stack.

4. The omnidirectional antenna of claim 1 wherein said truncated flared apart reflecting surface pairs further include a notch on an outer edge wherever said helically directed transmission lines intersect said flared apart reflecting surfaces.

5. The omnidirectional antenna of claim 1 wherein each truncated flared apart reflecting surface pair includes a pair of hubs, one in each of the truncated flared apart reflecting surfaces, for mounting and axially aligning one of said nonconductive spacing collars with said each truncated flared apart reflecting surface pair.

6. The omnidirectional antenna of claim 1 wherein said plurality of transmission lines each have an equal electrical length.

7. The omnidirectional antenna of claim 1 wherein said plurality of transmission lines each has a different electrical length so as to provide said omnidirectional antenna with a main beam tilted in elevation.

8. The omnidirectional antenna of claim 1 wherein each of the upper and lower surfaces of said flared apart reflecting surface pairs is conically shaped.

9. The omnidirectional antenna of claim 1 wherein the electromagnetic energy radiating elements are oriented so as to transmit and receive vertically polarized electromagnetic energy.

10. An omnidirectional antenna comprising:

a plurality of axially aligned electromagnetic energy radiating elements;

a plurality of truncated flared apart reflecting surface pairs connected in an aligned stack, each pair including an upper surface disposed above and a lower surface disposed below one of said radiating elements, adjacent pairs in the stack being attached to one another about their outer circumferences;

a plurality of nonconductive spacing collars, each positioned between the upper and lower surfaces of one of said pairs of reflecting surfaces along the axis thereof and around the respective radiating element disposed between said one of said pairs of reflecting surfaces;

a plurality of pairs of hubs, each hub having an annular groove for maintaining one of said nonconductive spacing collars therein, each of said pairs of hubs including two hubs mounted opposite one another with one of the two hubs in the upper surface of one of said truncated flared apart reflecting surface pairs and the other of the two hubs in the lower surface of said one of said truncated flared part reflecting surface pairs so as to hold a nonconductive spacing collar therebetween in the grooves of the two hubs;

a stiff radome forming a cylinder about the outer circumference of the reflecting surfaces of said plurality of truncated flared apart reflecting surface pairs;

means for attaching said radome to said reflecting surface pairs so that said reflecting surface pairs are supported in a vertical stack by said radome; and means for conducting electromagnetic energy to each of said radiating elements.

11. The omnidirectional antenna of claim 10 further comprising a power divider supported beneath a lowermost reflecting surface of said plurality of truncated flared apart reflecting surface pairs and wherein said conducting means comprises a plurality of transmission lines electrically connected to said power divider, a first of said transmission lines extending beneath the lowermost reflecting surface of said plurality of truncated flared apart reflecting surface pairs into connection with the radiating element disposed above said lowermost reflecting surface, the remaining transmission lines being helically directed along the cylinder formed by said radome, each of said remaining transmission lines being fed between two adjacent pairs of flared apart reflecting surface pairs from the outer circumference of said pairs into connection with one of said radiating elements.

12. The omnidirectional antenna of claim 11 wherein said remaining transmission lines are helically directed along the cylinder formed by said radome at an angle between 37° and 41°.

13. The omnidirectional antenna of claim 10 wherein said means for attaching comprises a plurality of clips connected to adjacent reflecting surface pairs at the outer circumference of the upper surface of one of the pairs of the adjacent reflecting surface pairs and the outer circumference of the lower surface of the other one of the pairs in the adjacent reflecting surface pairs, said clips also being attached to said radome so that said radome functions to support said plurality of truncated flared apart reflecting surfaces in a vertical stack.

14. The omnidirectional antenna of claim 10 wherein each of said flared apart reflecting surfaces is conically shaped.

15. The omnidirectional antenna of claim 10 wherein said plurality of truncated flared apart reflecting surface pairs comprises at least three truncated flared apart reflecting surface pairs.

16. The omnidirectional antenna of claim 10 wherein the electromagnetic energy radiating elements are oriented so as to transmit and receive vertically polarized electromagnetic energy.

* * * * *